US006993940B2

(12) United States Patent
Rabinowicz et al.

(10) Patent No.: US 6,993,940 B2
(45) Date of Patent: Feb. 7, 2006

(54) TENNIS VEST HAVING KNIT-IN BALL POCKETS

(75) Inventors: Sigi Rabinowicz, Antwerp (BE); Natalie Shagalov, Haifa (IL)

(73) Assignee: Tefron Ltd., Bnei-Brak (IL)

( * ) Notice: Subject to any disclaimer, the term of this patent is extended or adjusted under 35 U.S.C. 154(b) by 479 days.

(21) Appl. No.: 10/235,233

(22) Filed: Sep. 5, 2002

(65) Prior Publication Data

US 2004/0045325 A1 Mar. 11, 2004

(51) Int. Cl.
*A41D 27/20* (2006.01)

(52) U.S. Cl. ..... 66/176; 66/171; 2/250

(58) Field of Classification Search ..... 66/169 R, 66/170, 171, 172 R, 173, 176, 177, 196; 2/238, 227, 247, 249, 250
See application file for complete search history.

(56) References Cited

U.S. PATENT DOCUMENTS

| | | | | | |
|---|---|---|---|---|---|
| 3,553,981 | A * | 1/1971 | Kuney | 66/79 |
| 3,602,914 | A * | 9/1971 | Castello | 2/90 |
| 3,744,059 | A * | 7/1973 | Hayes | 2/250 |
| 3,871,030 | A * | 3/1975 | Green | 2/238 |
| 4,038,699 | A * | 8/1977 | Burn | 2/239 |
| 4,433,803 | A * | 2/1984 | Liberboim | 224/251 |
| 5,724,679 | A * | 3/1998 | Hans | 2/238 |
| 5,870,777 | A * | 2/1999 | Hans | 2/238 |
| 6,065,311 | A * | 5/2000 | Essig et al. | 66/64 |
| 6,460,380 | B1 * | 10/2002 | Sciacca et al. | 66/21 |

* cited by examiner

*Primary Examiner*—Danny Worrell
(74) *Attorney, Agent, or Firm*—Alston & Bird LLP

(57) ABSTRACT

A tennis vest is formed from a circularly knit fabric tube having an extended turned welt at a bottom region of the vest to form outer and inner plies. The plies are sewn together along longitudinal lines to form two pockets. A pair of openings are knitted into the outer ply, each opening associated with one pocket. The pockets and openings are sized to accommodate a tennis ball in each pocket. The pockets are preferably located on a rear side of the garment.

31 Claims, 3 Drawing Sheets

TENNIS VEST HAVING KNIT-IN BALL POCKETS

FIELD OF THE INVENTION

The invention relates to knit garments. The invention relates more particularly to garments having one or more pockets formed during a knitting process, and most particularly to a tennis vest having one or more pockets for holding tennis balls.

BACKGROUND OF THE INVENTION

For recreational tennis players who do not enjoy the luxury of having ball boys or ball girls to furnish new service balls to them, carrying extra service balls can be awkward. Some players stuff an extra ball or two in their shorts pockets, but this can be uncomfortable, and the balls can protrude to the extent that they interfere with one's stroke close to the body. It would be desirable to provide a more-convenient and less-restrictive way to carry extra service balls.

Pockets are conventionally provided in garments either by making a separate pocket and then sewing the pocket to the garment in registration with an opening formed through the garment, or by sewing a separate flap or patch of fabric to the garment fabric along three sides of the patch to form a so-called patch pocket. Thus, conventional pocket forming entails operations to cut out the fabric for forming the pocket and to sew the fabric to the garment, and may also require additional cutting and sewing operations to create the opening through the garment. These operations in most cases are performed by human workers using cutting and sewing devices. It would be desirable to automate the process of forming a pocket in a garment, and to automate as much as possible the entire process of making the garment.

SUMMARY OF THE INVENTION

The invention addresses the above needs and achieves other advantages by providing a knit garment and a method for making a knit garment wherein one or more pockets are formed in the garment during a circular knitting process for making the garment. To this end, a portion of the garment is knitted to have two plies that lie parallel one atop the other, with the plies being knitted together along two spaced circumferential lines to form a pocket between the plies bounded by the spaced lines. An opening is formed through one of the plies in the region of the pocket for accessing the interior of the pocket. In a preferred embodiment, the opening is knitted into the ply during circular knitting of the garment, and the opening is formed in the outer one of the plies.

Preferably, the two-ply portion of the garment is formed as an extended turned welt. In preferred embodiments, the extended turned welt forms a lower end portion of the garment. A bottom of the pocket preferably is formed by the seamless and continuously knit juncture between the inner ply and the outer ply at the bottom of the turned welt.

One embodiment of the invention comprises a tennis vest. The tennis vest includes an outer ply that extends from an upper end of the vest to a lower end of the vest, and an inner ply seamlessly and continuously knit to the lower end of the outer ply and extending parallel to the inner surface of the outer ply. The inner ply terminates at an upper edge spaced below the upper end of the vest, and the upper edge of the inner ply is knitted to the outer ply to form an extended turned welt at the lower portion of the vest. A pair of circumferentially spaced openings are knitted into the outer ply at a rear side of the vest, each opening sized for receiving a tennis ball through the opening into the space defined between the inner and outer plies. The plies preferably are attached together, such as by sewing, along a central line located between the two openings as well as along two lines circumferentially spaced on opposite sides of the central line, thus forming two separate pockets each accessible through one of the openings. The openings preferably are spaced above the bottoms of the pockets by a distance approximately equal to a diameter of a tennis ball.

BRIEF DESCRIPTION OF THE SEVERAL VIEWS OF THE DRAWINGS

Figure 1:
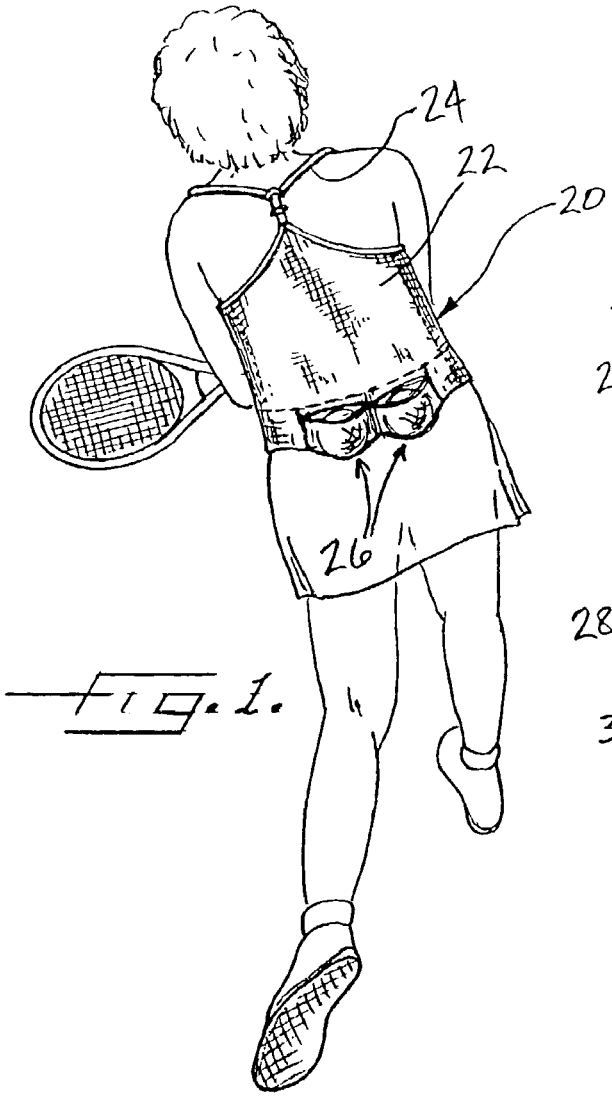
Figure 3:
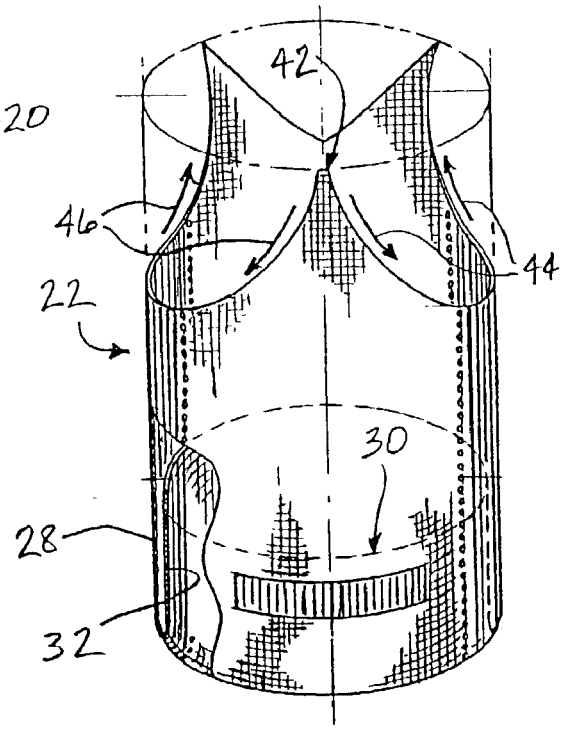
Figure 2:
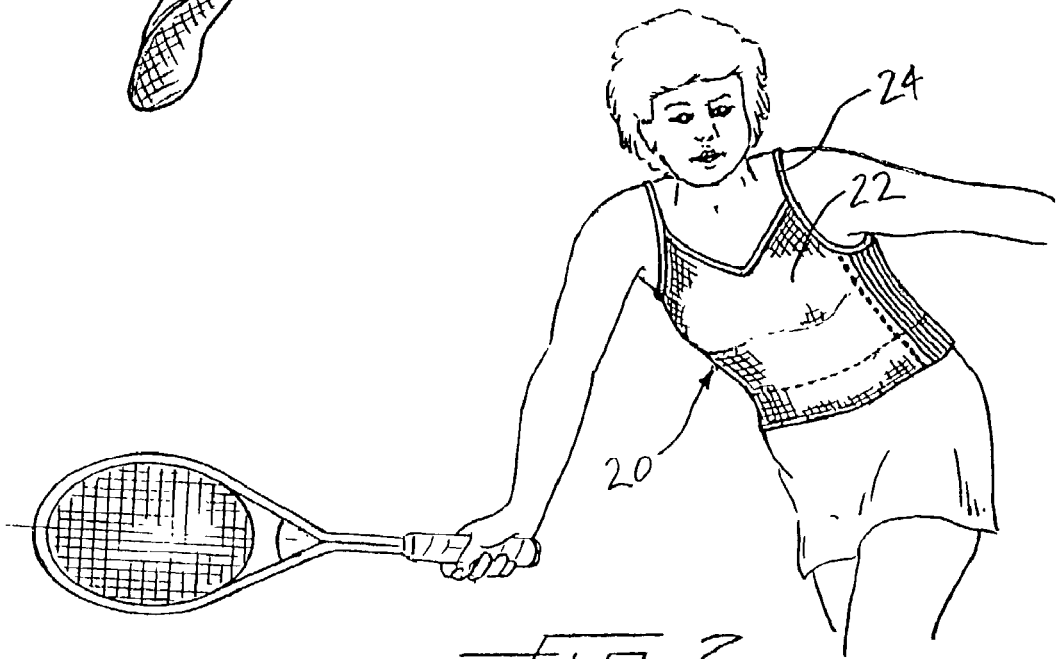
Figure 4:
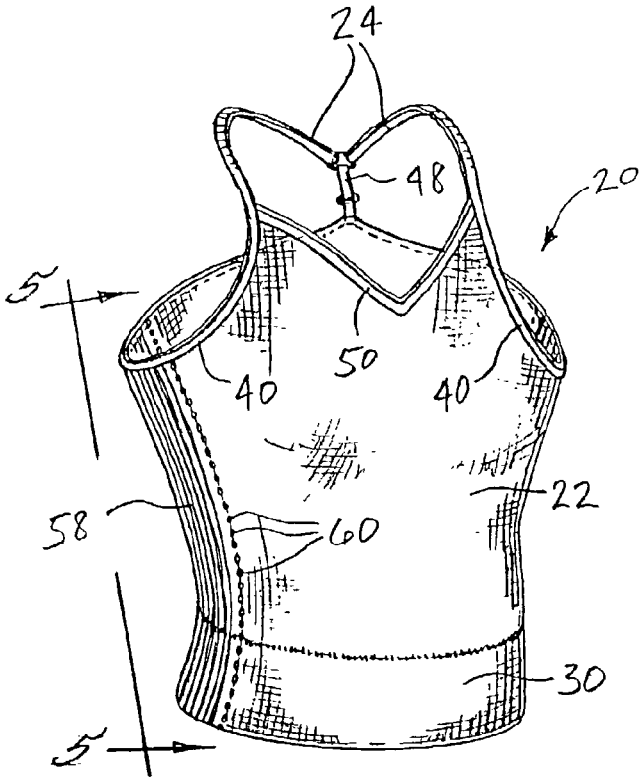
Figure 5:
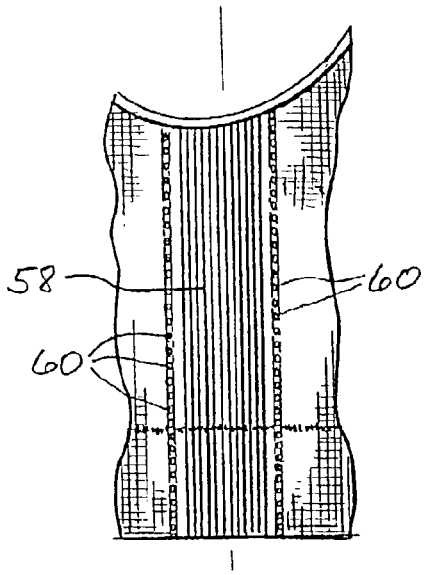
Figure 6:
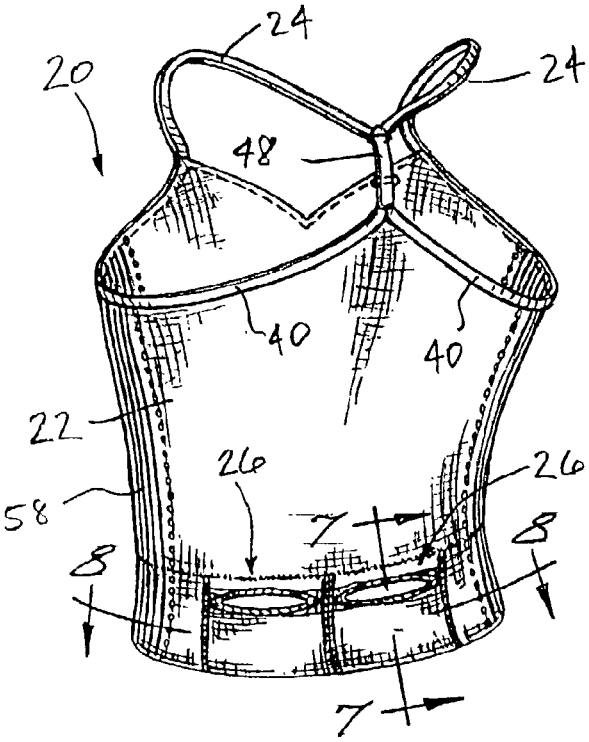
Figure 7:
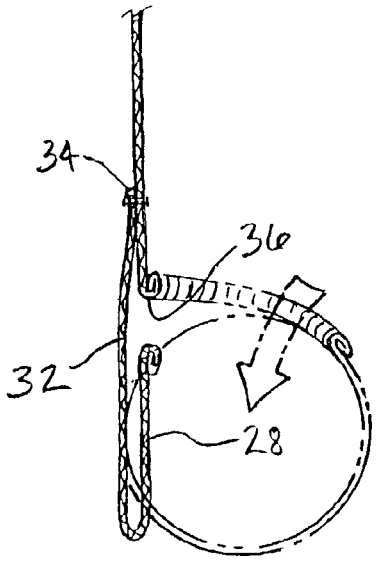
Figure 8:
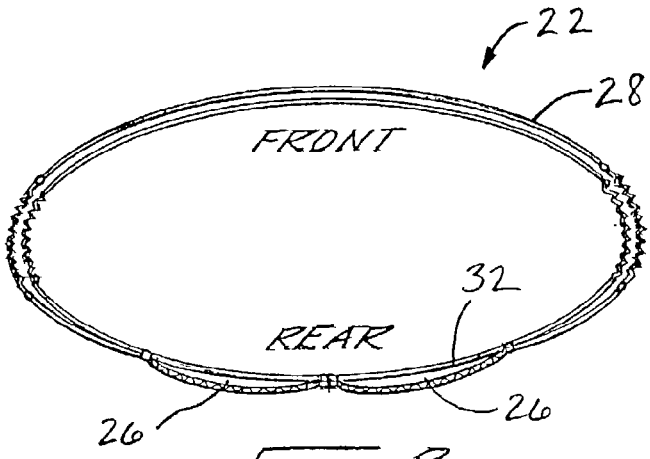
Figure 9:
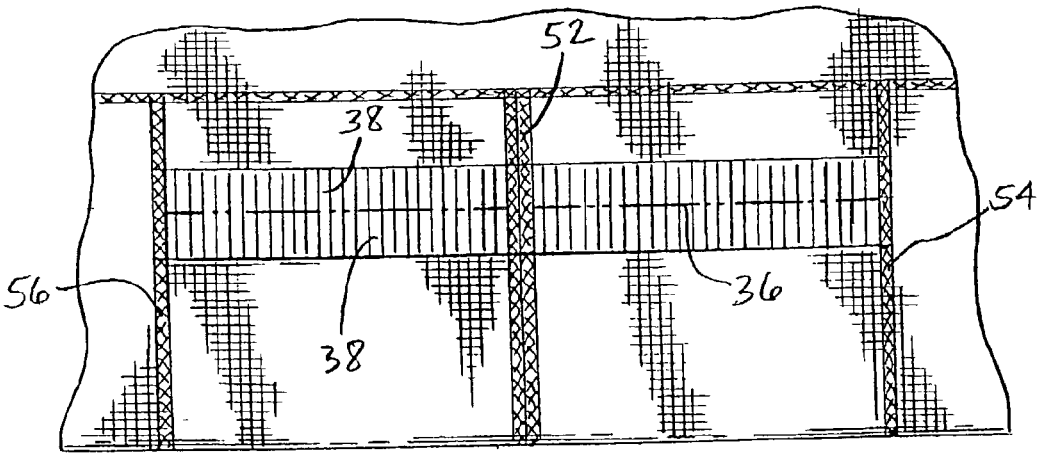
Figure 10:
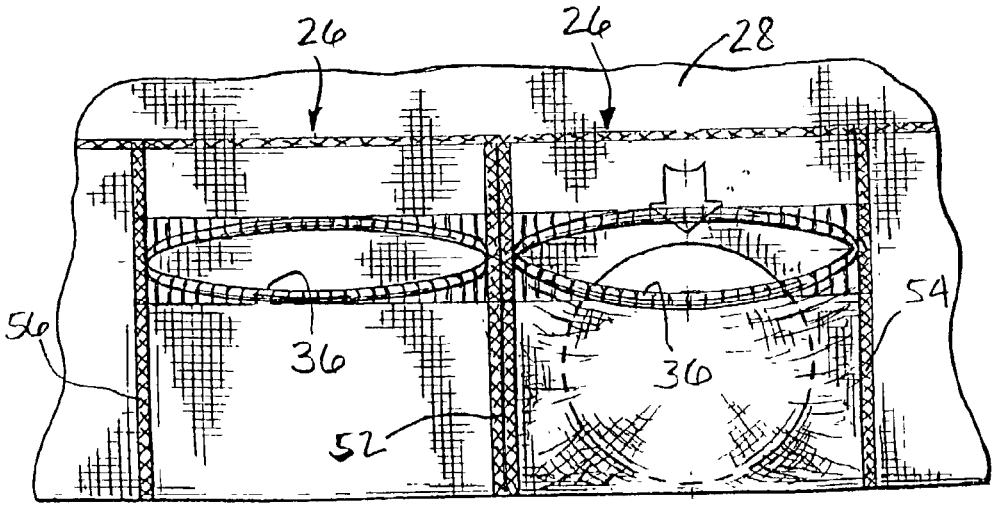

Having thus described the invention in general terms, reference will now be made to the accompanying drawings, which are not necessarily drawn to scale, and wherein:

FIG. 1 is a perspective rear view showing a person wearing a garment in accordance with one embodiment of the invention;

FIG. 2 is a perspective front view of the person wearing the garment of FIG. 1;

FIG. 3 is a perspective view of a tubular body portion of the garment of FIG. 1 prior to attaching shoulder straps thereto, partially broken away to reveal the two-ply construction of the lower end portion of the body portion;

FIG. 4 is a front perspective view of the garment of FIG. 1;

FIG. 5 is a fragmentary side elevation of the garment viewed along the direction indicated by line 5—5 in FIG. 4;

FIG. 6 is a rear perspective view of the garment of FIG. 1;

FIG. 7 is a cross-sectional view along line 7—7 of FIG. 6;

FIG. 8 is a cross-sectional view along line 8—8 of FIG. 6;

FIG. 9 is an enlarged fragmentary elevation of the rear pocket region of the garment, with the pockets empty and the pocket openings closed; and FIG. 10 is a view similar to FIG. 9 showing the pocket openings open and a tennis ball held in one of the pockets.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

A circularly knit garment 20 in accordance with one embodiment of the invention is depicted in the drawings. The illustrated garment 20 is a tennis vest, but the invention is not limited to tennis vests and can be applied to many types of circularly knit garments. The garment 20, as illustrated, preferably is a substantially seamless circularly knit garment, meaning that the tubular body portion of the garment that encircles the wearer's torso is knit as a tubular structure without any side seams extending lengthwise along the garment. However, the invention can also be applied to garments that are not substantially seamless but that are formed from fabric knit on a circular knitting machine.

The garment 20 comprises a tubular body portion 22 (shown in isolation in FIG. 3) for encircling the torso, and shoulder straps 24 affixed to the body portion. The illustrated embodiment has shoulder straps 24 in the style of a T-back or racer back configuration, but various other configurations of shoulder straps could be used instead. The shoulder straps also could be formed integrally with the body portion 22 by cutting the circular knit fabric tube from which the garment is formed so as to form shoulder strap portions. The body portion 22 includes two pockets 26 on the rear side of the body portion for holding tennis balls as depicted in FIG. 1. The balls are held securely and in a position that does not obstruct or hinder the player's freedom of movement while playing, yet the player can readily reach back with the free hand and remove a ball from one of the pockets or place a new ball into one of the pockets.

The body portion 22 of the illustrated embodiment of the invention is knitted on a circular knitting machine, preferably a machine having electronic needle selection. The body portion 22 is knitted as a fabric tube having an outer ply 28 that extends the full length of the body portion. At the lower end of the body portion 22 an extended turned welt 30 is formed in known fashion by reversing the knitting direction and transferring the knitting from the cylinder needles to the dial needles so as to knit an inner ply 32. The inner ply 32 extends for a length somewhat greater than a diameter of a tennis ball, for example, about 4 inches. The upper edge 34 of the inner ply 32 is then knit to the outer ply 28 in known fashion to complete the extended turned welt.

During the knitting of the outer ply 28 two openings 36 are knitted into the outer ply at the rear side of the body portion 22. The openings 36 extend in the coursewise circumferential direction of the fabric tube, each opening extending for a distance somewhat greater than a diameter of a tennis ball (e.g., about 3 inches). The openings 36 are spaced apart by a small distance in the circumferential direction and are spaced longitudinally above the bottom end of the extended turned welt 30 by a distance somewhat greater than a diameter of a tennis ball, e.g., about 3.5 inches. As shown in FIG. 9, a plurality of courses on either side of each opening 36 can be knitted in a wide rib pattern 38 (e.g., a 3×3 rib knit); this tends to cause the opposite edges of the opening 36 to roll up and open the opening as illustrated in FIGS. 7 and 10, which makes it easier to insert a ball into the pocket 26.

Once the tubular body portion 22 has been completed, it is taken off the knitting machine in the form shown in phantom lines in FIG. 3, i.e., the tube is basically cylindrical. To complete the fabrication of the garment 20, the tube is cut along cut lines at the top end of the tube to define the desired neckline and arm cut-outs for the garment, trim 40 (FIGS. 4 and 6) is sewn along the cut edges at the neckline, and shoulder straps 24 are attached. Preferably, the steps of cutting the neckline/arm cut-outs and attaching the trim and shoulder straps are all performed simultaneously using a known type of machine that cuts and sews a fold-over elastic tape to the cut fabric edge. More particularly, cutting and attachment of trim 40 begins at the point 42 in FIG. 3 and proceeds along the direction indicated by arrows 44 back up to the top end of the fabric tube to define one arm cut-out; the machine that applies the trim 40 is allowed to continue to run past the top end of the fabric tube to provide a length of trim that will form one of the shoulder straps 24. This process is then repeated beginning again at the point 42 and proceeding along the direction indicated by arrows 46 to form the other arm cut-out and the other shoulder strap 24. The free ends of the shoulder straps 24 are then connected to a conventional length-adjustable strap 48 that is sewn to the point 42 of the body portion. Before or after the formation of the shoulder straps, the neckline is cut and trim 50 is applied therealong. It will be recognized, of course, that the particular steps for cutting and attaching trim and the order in which they are performed can be varied depending on the desired shape of the top end of the body portion.

The final steps in finishing the garment 20 comprise sewing the inner and outer plies together along three longitudinally extending lines 52, 54, and 56 that extend from the bottom edge of the turned welt 30 up to the top edge of the turned welt, as best seen in FIGS. 9 and 10. The sew line 52 is centrally located between the two openings 36 and serves to bound each pocket 26 at an inner edge thereof. The lines 54 and 56 are circumferentially spaced on opposite sides of the central sew line 52 each by a distance somewhat greater than a tennis ball diameter, e.g., about 3.5 inches, and serve to bound the outer edges of the pockets 26.

Thus, it can be seen that the amount of fabrication required after circular knitting is relatively slight, such that the garment can be produced efficiently with a minimum of labor needed.

It will be understood that the garment can be knitted from a variety of different yarn types and sizes, and various knit patterns and features can be knitted into the garment. In one embodiment as shown in the drawings, each lateral side region of the body portion 22 includes a vertical rib knit panel 58 extending the length of the body portion. At least the rib knit panel 58 incorporates elastic yarns (e.g., covered or uncovered spandex), such that the panels 58 provide resilient stretchability particularly in the circumferential direction. Additionally, holes 60 for ventilation/decoration can be knit into the garment. These are only some examples of the various features that can optionally be included in the garment.

The illustrated and described embodiment has the pockets bounded at the bottom end by the bottom edge of the turned welt 30 and at the top end by the top edge of the turned welt. However, it is also possible for a pocket to be bounded at top and bottom by any two lines along which the two plies are knitted together in some fashion. It is also possible to form the opening into the pocket by cutting one of the plies rather than knitting the opening into the ply during circular knitting; however, knitting the opening is preferred because it avoids the extra cutting step.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A substantially seamless garment, comprising:

a circularly knit tubular body portion for encircling a wearer's torso, wherein a lower end portion of the body portion is knitted as an extended turned welt to have an inner ply and an outer ply in parallel overlying relation, the plies being knitted together along two circumferentially extending lines spaced apart along the body portion; and a first opening formed in the outer ply, whereby a pocket is defined between the outer and inner plies bounded by the two spaced lines and the first opening in the outer ply provides access to an interior of the pocket.

2. The garment of claim 1, further comprising shoulder straps attached to an upper end of the tubular body portion.

3. The garment of claim 1, wherein the first opening in knitted into the outer ply.

4. The garment of claim 3, further comprising a second opening knitted into the outer ply circumferentially spaced from the first opening, the outer and inner plies being attached together along a line located between the first and second openings, so as to form two pockets.

5. The garment of claim 1, wherein the pocket has a bottom end defined by a juncture between the inner and outer plies, and a top end defined by an upper end of the turned welt at which the inner and outer plies are knitted together.

6. The garment of claim 5, wherein the inner and outer plies are attached together along a pair of circumferentially spaced lines that respectively bound opposite side edges of the pocket.

7. The garment of claim 5, wherein the opening is spaced above the bottom end of the pocket by a distance approximating a diameter of a tennis ball.

8. The garment of claim 1, wherein the opening is located on a rear side of the tubular body portion that overlies the wearer's lower back.

9. A method for making a substantially seamless garment, comprising the steps of:

circularly knitting a tubular body portion for encircling a wearer's torso, wherein a lower end portion of the body portion is knitted as an extended turned welt to have an inner ply and an outer ply in parallel overlying relation, the inner and outer plies being knitted together along two circumferentially extending lines spaced apart along the body portion; and forming a first opening through the outer ply, whereby a pocket is defined between the outer and inner plies and the first opening in the outer ply provides access to an interior of the pocket.

10. The method of claim 9, wherein the forming step comprises knitting the first opening in the outer ply.

11. The method of claim 10, further comprising the steps of knitting a second opening into the outer ply circumferentially spaced from the first opening, and attaching the outer and inner plies together along a line located between the first and second openings, so as to form two pockets.

12. The method of claim 9, further comprising the step of attaching shoulder straps to an upper end of the tubular body portion.

13. The method of claim 9, further comprising the steps of cutting an upper end of the body portion along a cut line and attaching trim to the body portion along the cut line.

14. A substantially seamless garment, comprising:

a circularly knit tubular body portion for encircling a part of a wearer's body, the body portion comprising a tubular first ply having a length extending from a first end to an opposite second end of the first ply, and a tubular second ply continuously and seamlessly knit to the second end of the first ply and extending less than the length of the first ply toward the first end thereof and terminating at a first edge of the second ply, the first and second plies lying parallel and adjacent to each other to form a two-ply structure, one of the plies comprising an outer ply and the other ply comprising an inner ply with respect to the wearer's body; and a pocket defined between the outer and inner plies, the outer ply having an opening therethrough for inserting items into and removing items from the pocket.

15. The garment of claim 14, wherein the first ply comprises the outer ply.

16. The garment of claim 14, wherein the opening is knit into the outer ply during circular knitting of the body portion.

17. The garment of claim 14, wherein the first edge of the second ply is knit to the first ply.

18. The garment of claim 14, wherein the garment is configured to encircle the wearer's torso, the first end of the first ply defining an upper end of the body portion and the second end of the first ply defining a lower end of the body portion with respect to the wearer's torso.

19. The garment of claim 18, wherein an upper edge of the second ply is spaced below the upper end of the body portion, whereby an upper portion of the body portion is a one-ply structure and a lower portion of the body portion is a two-ply structure.

20. The garment of claim 19, wherein the second ply comprises the inner ply.

21. The garment of claim 20, further comprising a second pocket defined between the inner and outer plies, and a second opening through the outer ply for inserting items into and removing items from the second pocket.

22. The garment of claim 21, wherein the openings are knit into the outer ply during circular knitting thereof.

23. The garment of claim 21, wherein the two pockets are spaced in a circumferential direction of the garment.

24. The garment of claim 23, wherein the outer and inner plies are attached to each other along generally longitudinal lines defining opposite edges of each pocket.

25. The garment of claim 18, wherein the pocket is located at a rear side of the body portion.

26. The garment of claim 18, further comprising shoulder straps attached to the upper end of the body portion.

27. A garment, comprising:

a knit tubular body portion for encircling a wearer's torso, the body portion comprising a tubular outer ply extending from an upper end to a lower end of the body portion, and a tubular inner ply parallel and adjacent to a lower portion of the outer ply, the outer and inner plies being continuously and seamlessly knit to each other at the lower end of the body portion, the inner ply extending less than the length of the outer ply and being attached to each other at an upper edge of the inner ply that is spaced below the upper end of the body portion, the plies being generally unattached to each other between the lower end of the body portion and the upper edge of the inner ply; and a first pocket defined between the outer and inner plies, the outer ply defining a first opening for inserting items into and removing items from the first pocket, wherein the first opening is knitted into the outer ply during knitting thereof.

28. The garment of claim 27, wherein the first pocket is located at a rear side of the body portion.

29. The garment of claim 27, further comprising a second pocket defined between the plies, and a second opening knitted into the outer ply for inserting items into and removing items from the second pocket.

30. The garment of claim 29, wherein each pocket and opening are structured and arranged to accommodate a tennis ball.

31. The garment of claim 30, wherein the opening of each pocket is spaced above a bottom edge of the pocket by a distance approximating a diameter of a tennis ball.

* * * * *